United States Patent [19]

Nagata et al.

[11] Patent Number: 4,681,994

[45] Date of Patent: Jul. 21, 1987

[54] HIGH PRECISION AND COMPACT CONTACT SWITCH

[75] Inventors: Kunio Nagata, Otokuni; Tatsuo Aoi, Ibaraki; Norio Iwakiri, Otokuni; Hiroshi Osumi, Kurayoshi; Nobuyuki Ogata, Kurayoshi; Norihito Yamane, Kurayoshi, all of Japan

[73] Assignee: Omron Tateisi Electronics Co., Kyoto, Japan

[21] Appl. No.: 795,767

[22] Filed: Nov. 7, 1985

[30] Foreign Application Priority Data

Nov. 13, 1984 [JP] Japan ..... 59-239646

[51] Int. Cl.[4] ..... H01H 13/10

[52] U.S. Cl. ..... 200/16 B; 200/16 C; 200/61.76; 200/340

[58] Field of Search ..... 200/61.76, 159 R, 16 B, 200/16 C, 340, DIG. 25

[56] References Cited

U.S. PATENT DOCUMENTS

| | | | |
|---|---|---|---|
| 2,065,904 | 12/1936 | Meuer | 200/61.76 X |
| 2,155,765 | 4/1939 | Meuer | 200/61.76 |
| 4,564,730 | 1/1986 | Tomizu et al. | 200/61.76 X |

*Primary Examiner*—A. D. Pellinen
*Assistant Examiner*—Morris Ginsburg
*Attorney, Agent, or Firm*—Wegner & Bretschneider

[57] ABSTRACT

A high precision and compact contact switch which comprises a housing, a pair of fixed contact elements fixedly supported within the housing, a plunger axially slidably extending into the housing, a generally cylindrical movable contact member, a support piece for the support of the fixed contact elements and a biasing spring. The generally cylindrical movable contact member is tiltably carried by the plunger so as to extend transversely in relation to the plunger. The support piece is preferably made out of synthetic resin. The biasing spring is used for urging the opposite end portions of the movable contact member in order to contact the respective fixed contact elements.

2 Claims, 8 Drawing Figures

HIGH PRECISION AND COMPACT CONTACT SWITCH

BACKGROUND OF THE INVENTION

The present invention generally relates to an electric switch and, more particularly, to a high precision, compact contact switch.

Hitherto, contact switches generally used for detecting the position of an object have utilized either a reversing mechanism and leaf contacts. Since these prior art contact switches make use of a leaf spring, they have a problem in that change in operating position of the contact arrangement is apt to occur frequently.

In view of the foregoing, a high precision compact switch capable of exhibiting a precision in the order of microns has been proposed such as disclosed in Japanese Utility Model Application No. 58-127136 filed in Japan in the name of the same assignee of the present invention. The switch disclosed therein is of a construction wherein a contact element made of a rod is structured to provide a cross-bar design and wherein a movable contact element in the form of a rod provided in a plunger is urged by a return spring to constantly contact a pair of fixed contact elements each in the form of a rod secured rigidly to a casing.

It has, however, been found that, in the switch disclosed in the above mentioned application, since the pair of the fixed contact elements are securely fitted into respective apertures in the casing independently of each other in separated form, they cannot always be fabricated accurately in parallel relation to each other or in perpendicular relation to the direction of movement of the movable contact element. In view of this, it is difficult to guarantee the high precision in the order of submicrons, that is, 1 $\mu$m or smaller.

SUMMARY OF THE INVENTION

The present invention has been devised with a view to substantially eliminating the above described problems inherent in the prior art contact switches and has for its essential object to provide an improved contact switch precise and reliable in switching operation, and compact in size.

To this end, a contact switch herein provided according to the present invention is featured in that a pair of fixed contact elements are formed by dividing a single contact member into two pieces after the single contact member has been insert-molded in a support block of synthetic resin and are then fixed in position within a casing.

With the above features, the pair of the fixed contact elements may be regarded as respective parts of a unitary structure together with the support block. Because of this, the pair of the fixed contact elements can be positioned exactly and accurately in degree of parallelism as well as degree of perpendicularity. This in turn brings about such an advantage that the accuracy in switch operating position can be further increased thereby ensuring the high accuracy to be not greater than 1 $\mu$m.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figure 1:
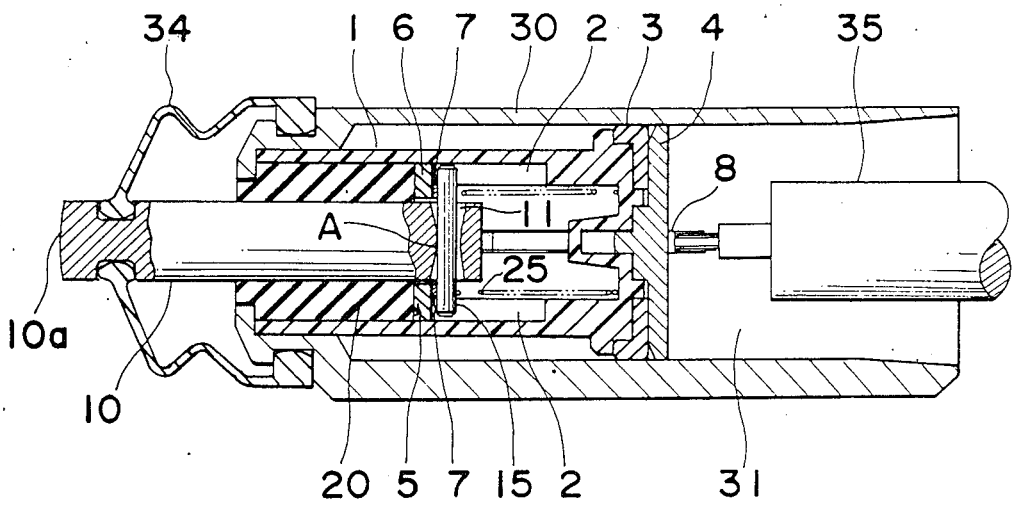
FIG. 1 is a longitudinal sectional view of a contact switch embodying the present invention.
Figure 2:
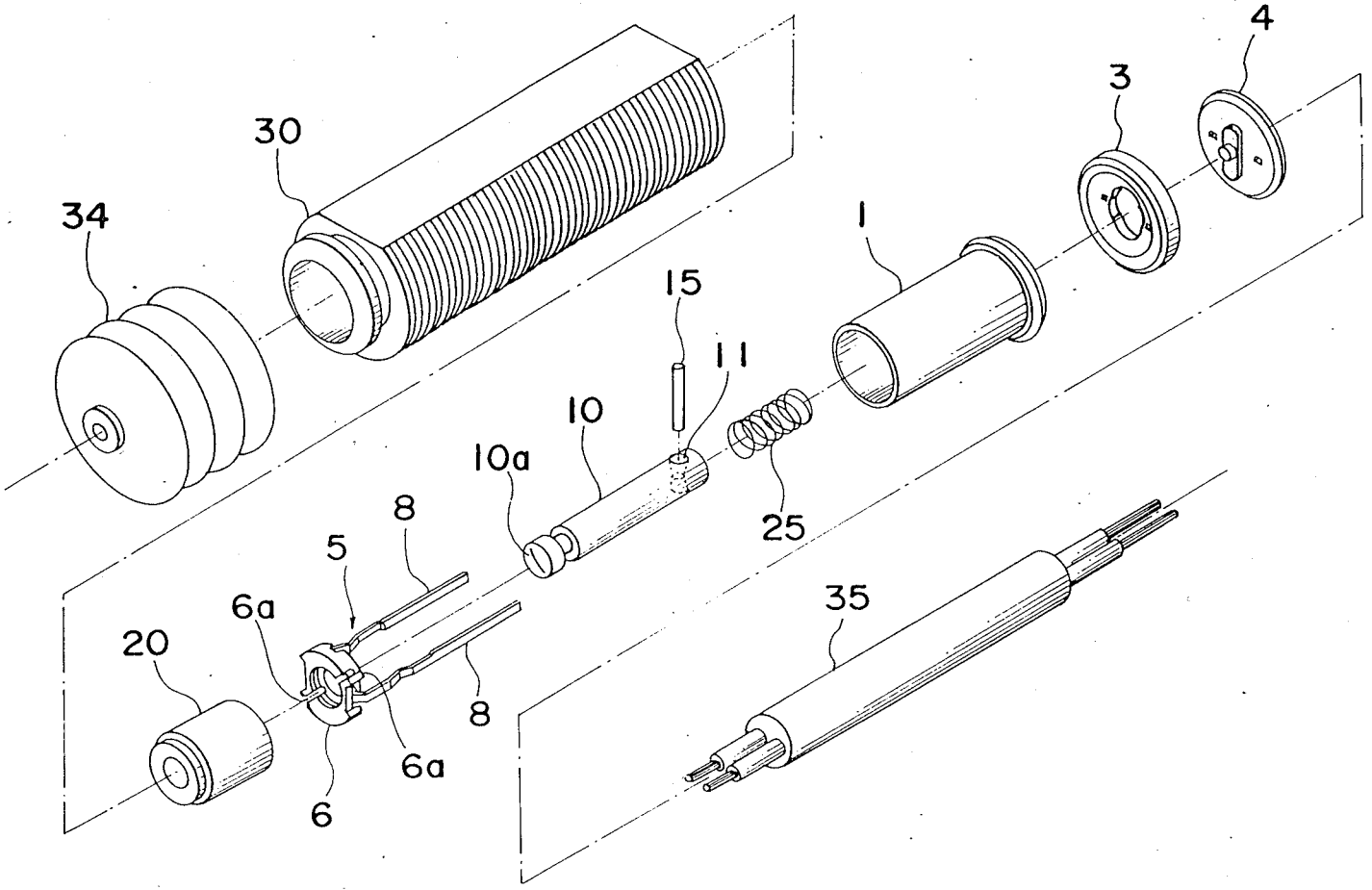
FIG. 2 is an exploded view of the contact switch.

Referring first to FIGS. 1 and 2, a contact switch shown therein comprises a generally cylindrical inner casing 1, a fixed contact block 5 disposed within the inner casing 1, a plunger 10 extending exteriorly into the inner casing 1 through a bearing sleeve 20 for axial movement between projected and depressed positions, a movable contact member 15, a return spring 25 disposed within the inner casing 1 and applying a biasing force through the movable contact member 15 to the plunger 10 thereby to bring the plunger 10 to the projected position, and a generally cylindrical outer casing 30 accommodating the inner casing in coaxial relation to each other.

The inner casing 1 is made of any suitable synthetic resin by the use of any known molding technique having its opposite ends opened and closed, respectively. This casing 1 is fixedly inserted into the outer casing 30 with its closed end situated within the outer casing 30, said closed end of the inner casing 1 being fitted with an end plate 4 through an annular packing 3. Both the packing 3 and the end plate 4 are provided for any possible intrusion of a resinous material which will be filled into a rear chamber 31 defined within the outer casing 30 on one side of the end plate 4 remote from the inner casing 1. The filling of the resinous material into the rear chamber 31 is carried out in any suitable manner after the fabrication of the contact switch.

The fixed contact block 5 comprises a generally ring-shaped support 6 made of synthetic resin and a pair of lead strips 8 integrally formed at one end with respective, generally semicircular contact elements 7. The lead strips 8 extend laterally outwardly from the ring-shaped support 6 in the opposite directions away from each other while the semicircular contact elements 7 are embedded in the ring-shaped support 5 so as to occupy the radially opposite portions of the shape of a circle concentric with the ring-shaped support 6. It is to be noted that, in an assembled condition of the switch as shown in FIG. 1, the lead strips 8 extending laterally outwardly from the support 6 are bent to protrude parallel to each other in one direction counter to the plunger 10.

Figure 3:
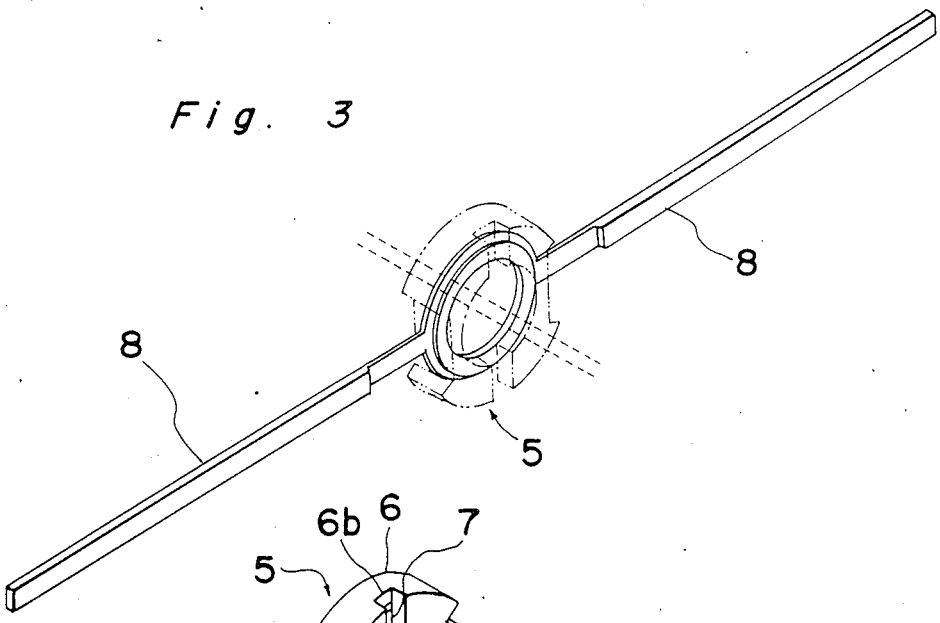
FIG. 3 is a perspective view of a fixed contact block shown for the purpose of explanation of how a fixed contact assembly is formed.
Figure 4:
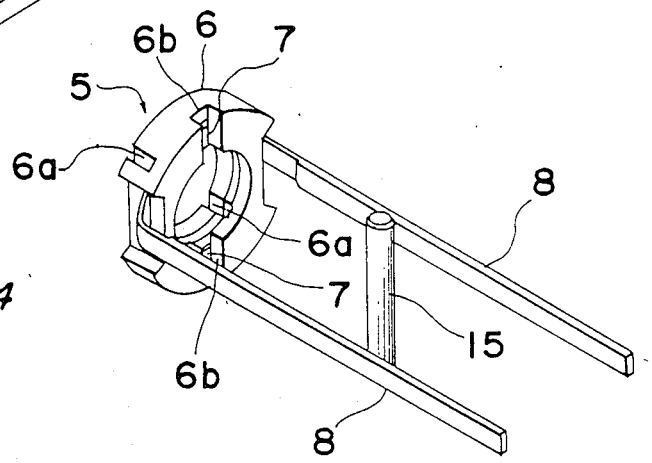
FIG. 4 is a perspective view of the fixed contact assembly in complete form.

The fixed contact block 5 of the structure described above is manufactured, as shown in FIG. 3, by preparing a contact member of one-piece construction having a ring body and a pair of strips radially outwardly extending from the ring body in the opposite directions away from each other; forming the ring-shaped support 6 by the use of an insert-molding technique in such a way as to have the ring body completely embedded therein in concentric relation to the support 6; effecting a so-called half-cutting to the resultant assembly in a manner as shown by the broken lines in FIG. 3 to divide the ring body into two pieces, that is, the fixed contact elements 7, and finally bending the strips, i.e., the lead strips 8, so as to protrude in a direction parallel to the imaginary axis passing through the center of the support 6 as best shown in FIG. 4. It is to be noted that reference numeral 6*a* represents a pair of oppositely spaced recesses formed in the ring-shaped support 6 as respective marks of half-cutting effected to divide the ring body into the fixed contact elements 7. It is also to be noted that, during the molding of the support 6 with the ring body and, hence, the fixed contact elements 7 embedded therein, cutouts 6*b* are simultaneously formed in the support 6, through which cutouts 6*b* the fixed elements 7 are partially exposed exteriorly of the support 6, respectively, for engagement with the movable contact member 15 as will be described later.

The fixed contact block 5 so formed as hereinabove described is inserted into the inner casing 1 with the lead strips 8 oriented towards the closed end of the casing 1 and is held in position in abutment with an inner end of the bearing sleeve 20 which is subsequently inserted into the inner casing 1 to substantially close the open end of the casing 1. The lead strips 8 extend through the closed end of the casing 1, then the packing 3 and finally the end plate 4 and are connected with external wiring 35.

The plunger 10 having outer and inner ends opposite to each other extends axially slidably through the bearing sleeve 20 with the outer end protruding exteriorly of the inner casing 1 and also the outer casing 30 accommodating the inner casing 1. A dust preventing and/or water-proof bellows 34 surrounds a portion of the plunger 10 between the outer end of the plunger 10 and the outer casing 30 with its opposite ends engaged respectively to a portion of the plunger 10 adjacent the outer end thereof and one end of the outer casing 30 adjacent the sleeve 20. The outer end of the plunger 10 has its end face 10*a* rounded for the purpose which will be described later.

The inner end of the plunger 10 situated within the inner casing 1 is formed with a radial bearing bore 11 extending at right angles to the longitudinal axis thereof for the support of the movable contact member 15 which is employed in the form of a rod of circular cross-section. As best shown in FIG. 1 as well as FIG. 8, the bearing bore 11 is of a shape having its intermediate portion constricted radially inwardly so as to provide the point A of pivot for the movable contact member 15 as will be described later, the diameter of said bearing bore 11 gradually increasing towards the opposite ends of said bore 11. The diameter of the radially inwardly constricted portion of the bearing bore 11 is substantially equal to or slightly greater than the diameter of the movable contact member 15 and is such that, with the movable contact member 15 received in the bearing bore 11 with its opposite end situated on respective sides of the plunger 10, a substantial line contact defining the pivot point A can be observed between the movable contact member 15 and the radially inwardly constricted intermediate portion of the bearing bore 11. With the movable contact member 15 received in the bearing bore 11, the movable contact member 15 is movable together with the plunger 10 with its opposite ends guided in respective guide grooves 2 which are defined in the inner peripheral surface of the inner casing 1 so as to extend axially of the casing 1 while being diametrically spaced 180° from each other about the longitudinal axis of the plunger 10. It is to be noted that the fixed contact block 5 is so fixedly positioned within the inner casing 1 that, when and so long as the plunger 10 is moved to the projected position as shown in FIG. 1 as biased by the return spring 25 which is interposed between the movable contact member 15 and the closed end of the inner casing 1, the opposite ends of the movable contact member 15 can be received in the respective cutouts 6*b* in the ring-shaped support 6 and held in contact with the fixed contact elements 7 through the cutouts 6*b*, respectively.

The end face 10*a* of the plunger 10 is so rounded as to occupy a portion of the shape of a sphere having a diameter equal to the distance between the end face 10*a* and the pivot point A at which the movable contact member 15 contacts the plunger 10.

While the contact switch according to the present invention is constructed as hereinbefore described, it operates in the following manner.

Because of the employment of the return spring 25 acting to urge the movable contact member 15 to contact the fixed contact elements 7 in the ring-shaped support 6, the contact switch shown and described is a normally closed switch. When, however, the plunger 10 is moved towards the depressed position by the application of an external pushing force to the rounded end face 10*a*, the movable contact member 15 is moved together with the plunger 10 against the return spring 25, separating away from the fixed contact elements 7 to open the circuit.

Figure 5:
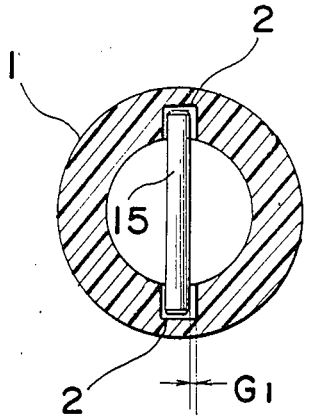
FIGS. 5 to 7 are diagrams used to explain the accuracy in switch operation position.
Figure 6:
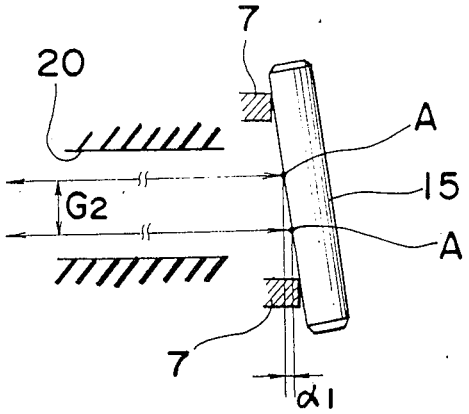
Figure 7:
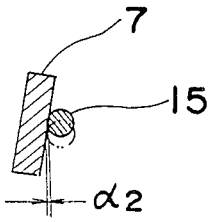

During the movement of the plunger 10, the opposite ends of the movable contact member 15 are slidingly guided in the respective guide grooves 2. In practice, however, there is a gap, shown by G1 in FIG. 5, between each of the opposite ends of the movable contact member 15 and the wall defining the respective guide groove 2. Also, as shown in FIG. 6, while the movable contact member 15 is tiltable about the pivot point A within the bearing bore 11, there is a gap G2 between the periphery of the plunger 10 and the inner periphery of the casing 1. Accordingly, if a deviation occurs in parallelism as a result of the displacement of the fixed contact elements 7 in the axial direction, the result would be that the positioning accuracy of the plunger 10 is deviated by a value $\alpha 1$ as shown in FIG. 6. Moreover, if a deviation occurs in perpendicularity as a result of the inclination of any one of the fixed contact elements 7 as shown in FIG. 7, the result would be that the position accuracy of the movable contact member 15 is deviated by a value $\alpha 2$ as shown. The presence of these deviations brings about an error in the position from which the opposite ends of the movable contact member 15 start separating away from the fixed contact elements 7 and, therefore, a high precision in the order of submicrons can not be warranted.

In view of the foregoing, and according to the present invention, the fixed contact elements 7 are formed in the manner as hereinbefore described with particular reference to FIGS. 3 and 4, i.e., by embedding the contact member, having the ring body and the strips, in the support 6 during the molding of the support 6, and then by effecting the half-cutting to divide the ring body into the fixed contact elements 7. Therefore, both the parallelism and the perpendicularity are accurately preserved and no error will occur in the operating position, warranting a high precision in the order of submicrons.

The end face 10*a* of the plunger 10 has been described as rounded so as to occupy a portion of the shape of a sphere having a diameter equal to the distance between the end face 10*a* and the pivot point A at which the movable contact member 15 contacts the bearing bore 11. This is because of the following reason.

Figure 8:
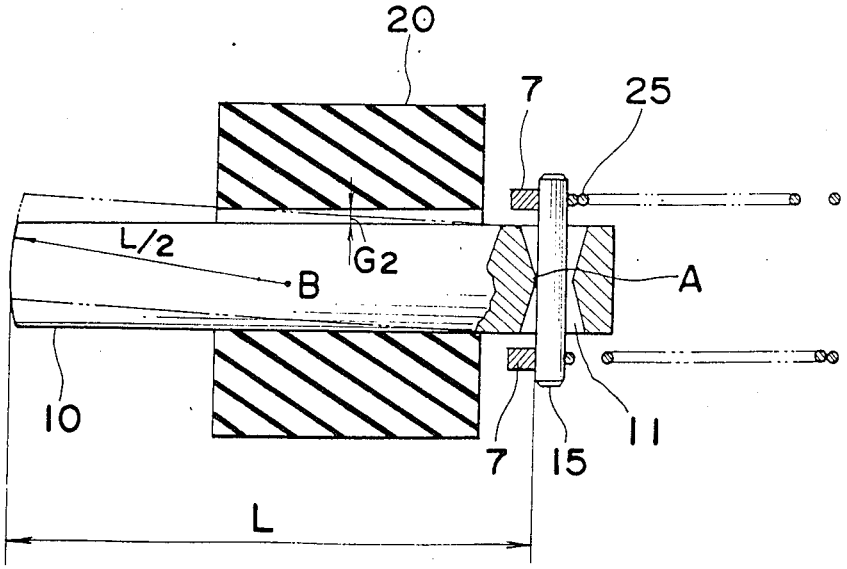
FIG. 8 is a fragmentary longitudinal sectional view, on an enlarged scale, showing how a plunger is supported in the contact switch embodying present invention.

Referring to FIG. 8, when the plunger 10 is received in the bearing sleeve 20, there is formed a slight gap G2 between the inner periphery of the bearing sleeve 20 and the periphery of the plunger 10. Accordingly, when the plunger 10 tilts as shown by the phantom line in FIG. 8, an error will be produced in the length L between the end face of the plunger 10 and the pivot point A. Because of this, the end face 10*a* of the plunger 10 is so rounded as to represent a spherical face occupying a portion of the shape of a sphere having its center lying at a point spaced half the length L inwardly from the end face 10*a* as indicated by B. With this design feature, the length L will no longer change even if the plunger 10 tilts, and accordingly, the accuracy of the operating position can further be increased. Needless to say, it is preferable that the radially inwardly constricted intermediate portion of the bearing bore 11 at which the movable contact member 15 contacts the plunger 10 is rounded so as to occupy a portion of the shape of the same sphere of a diameter equal to the length L, for the purpose of achieving ultra-high precision.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A contact switch assembly which comprises a housing; a pair of fixed contact elements fixedly supported within the housing, a plunger having first and second ends opposite to each other and axially slidably extending into the housing with the first and second ends situated exteriorly and interiorly of the housing; a generally cylindrical movable contact member tiltably carried by the plunger adjacent the second end so as to extend transversely of the plunger, said movable contact member having its opposite end portions adapted to contact the respective fixed contact elements; a support piece for the support of the fixed contact elements and made of synthetic resin; and means for urging the movable contact member to cause the opposite end portions of said movable contact member to contact the respective fixed contact elements, and wherein said fixed contact elements are embedded in said support piece.

2. The switch assembly as claimed in claim 1, wherein the first end of the plunger has its end face rounded so as to occupy a portion of the shape of a sphere having a diameter equal to the distance between said end face and the point at which the movable contact member tiltably contacts the plunger.

* * * * *